United States Patent [19]

Hammett et al.

[11] 4,222,501

[45] Sep. 16, 1980

[54] DUAL CHAMBER, CONTINUOUS ACTION DISPENSER

[75] Inventors: Roy Hammett, Miami, Fla.; Nicholas G. Capra, East Hanover, N.J.

[73] Assignee: James D. Pauls and J. Claybrook Lewis and Associates, Limited, Miami, Fla.

[21] Appl. No.: 927,563

[22] Filed: Jul. 24, 1978

[51] Int. Cl.[2] ..... B05B 11/00; F04B 43/08

[52] U.S. Cl. ..... 222/207; 222/213; 417/478; 417/544

[58] Field of Search ..... 222/207, 209, 321, 340, 222/212, 213; 239/329, 331, 333; 417/478, 479, 540–544; 138/30

[56] References Cited

U.S. PATENT DOCUMENTS

| | | | |
|---|---|---|---|
| 3,192,864 | 7/1965 | Notte | 417/542 X |
| 3,202,318 | 8/1965 | Black | 239/329 X |
| 3,486,663 | 12/1969 | Humphrey | 222/207 |
| 3,749,290 | 7/1973 | Micallef | 222/207 |
| 3,995,774 | 12/1976 | Cooprider et al. | 417/479 X |
| 3,995,776 | 12/1976 | Micallef | 222/207 |
| 4,146,155 | 3/1979 | Kutik et al. | 239/331 |

*Primary Examiner*—F. J. Bartuska
*Attorney, Agent, or Firm*—Oblon, Fisher, Spivak, McClelland & Maier

[57] ABSTRACT

A trigger operated dispenser includes a plurality of expansible chambers, with one of the chambers comprising a pumping chamber connected to be operated by the trigger, and another chamber connected to receive product from the pumping chamber and operative to expand and accumulate an amount of product for continuous discharge of the product through the nozzle, whereby continuous discharge of the product is obtained during both pressurization and intake modes of operation of the trigger operated pumping chamber.

4 Claims, 5 Drawing Figures

DUAL CHAMBER, CONTINUOUS ACTION DISPENSER

BACKGROUND OF THE INVENTION

This invention relates to mechanically operated dispensers for dispensing product under pressure, and more particularly, relates to such dispensers which have a trigger operator or actuator.

Many different types of mechanically operated dispensers are known in the prior art, including several different types of trigger operated dispensers. The mechanically operated dispensers were developed to fill a need not met by propellant operated dispensers and also to solve some of the problems which exist in connection with propellant operated dispensers. For example, the propellant operated dispensers utilize chemicals which are or may be harmful, and such dispensers must be designed to withstand substantial internal pressures. Moreover, special precautions must be exercised in filling and handling such dispensers as well as in disposing of them.

While the mechanically operated dispensers solve some of these problems, they are inconvenient to use in comparison with the propellant operated dispensers, and, with only a few exceptions, are only capable of obtaining intermittent sprays or spurts of material when the actuator is operated.

The trigger operated dispensers of the prior art are perhaps the most convenient to use because of the ease of operation thereof, due at least in part to the natural ability of a human hand to operate a trigger as compared with a push button or other pumping mechanism. However, none of the prior art trigger operated dispensers known to applicant are capable of obtaining other than intermittent spurts or discharges of material concomittent with reciprocation of the trigger. Examples of some prior art trigger operated dispensers are seen in U.S. Pat. Nos. 3,749,290 and 3,995,776. There are many uses of such devices where a continuous discharge of material is desirable.

With the present invention, a trigger operated dispenser is provided which is capable of obtaining a continuous discharge of material, and thus, performance characteristics similar to that of propellant operated dispensers are obtained. In accomplishing this result, the present invention provides a dispensing device having a plurality of chambers therein with one of the chambers comprising a pumping chamber and connected with the trigger operator or actuator, whereby reciprocation or pivotal movement of the trigger causes pumping action of the chamber. Another of the chambers comprises an accumulating chamber and is connected to receive product from the pumping chamber when the trigger is moved to pressurize product in the pumping chamber. The accumulated product in the accumulating chamber thus flows outwardly through the nozzle during the time the trigger is being returned to its forward, at-rest position for a subsequent pressurization stroke, whereby continuous discharge of product is obtained.

Moreover, the trigger operated, continuous action dispenser of the present invention can be constructed substantially completely from conventionally available components and requires only the addition of the accumulating chamber, with slight modifications to the manifold and shroud for accomodating the accumulating chamber. Of course, the device of the invention could be constucted with other than conventionally available components if desired.

OBJECTS OF THE INVENTION

It is an object of this invention to provide a trigger operated dispenser which includes means for obtaining a continuous discharge of material therefrom during both pressurization and intake strokes of the trigger.

Another object of the invention is to provide a trigger operated dispenser which includes a plurality of chambers with one of the chambers comprising a pumping chamber and connected with the trigger actuator for alternate enlargement and reduction of the volume of the pumping chamber upon intake and pressurization strokes of the trigger, respectively, and wherein another of the chambers comprises an accumulating chamber connected with the pumping chamber to receive product therefrom upon a pressurization stroke of the trigger, whereby an amount of material is accumulated in the accumulating chamber to obtain continuous discharge of product from the dispenser during both pressurization and intake strokes of the trigger.

DETAILED DESCRIPTION OF THE PREFERRED EMBODIMENT

Figure 1:
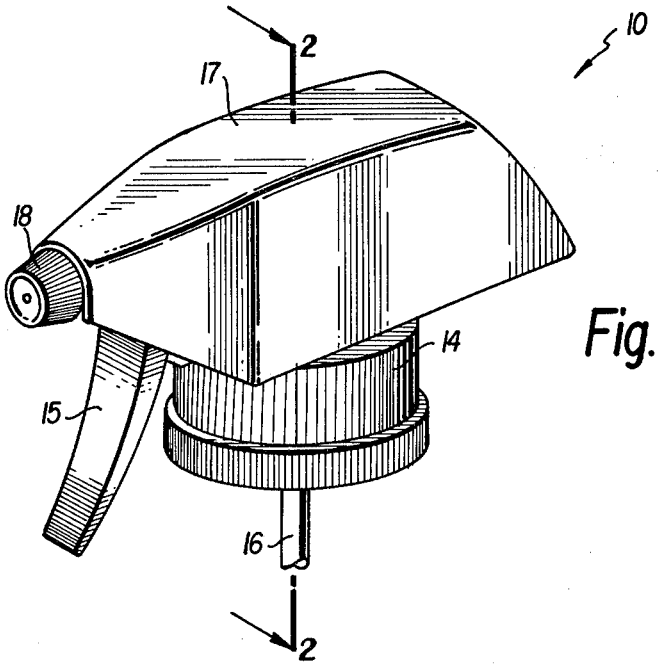
FIG. 1 is a perspective view of a trigger operated dispenser in accordance with the invention.

In the drawings, wherein like reference numerals indicate like parts throughout the several views, a dispenser in accordance with the invention is indicated generally at 10 and comprises a manifold 11, adapter sleeve 12, pumping chamber or bladder 13, connecting or attaching collar 14, trigger actuator or operator 15, dip tube 16, shroud 17, nozzle 18 and flexible, resiliently yieldable diaphragm 19.

The manifold comprises a substantially flat, rectangularly shaped valving plate 20 having cylindrical depending housing 21 formed on the underside thereof and having an open bottom end 22 and an opening 23 in the side thereof.

An oblong annular channel 24 is formed on the top surface of the valving plate 20 and a first opening 25 extends from the interior of the housing 21 to above the valving plate substantially centrally spaced relative to the annular channel 24. A second opening 26 extends downwardly from the top surface of the valving plate 20 from a location adjacent one end of the elongate annular channel 24 into communication with an elongate, axially extending outlet passage 27 formed in a forwardly projecting nozzle tube 28 integral with the manifold.

An outlet check valve housing 29 is formed on the manifold and extends coaxially downwardly within the housing 21 in radially inwardly spaced relationship thereto and has a ball valve 30 therein reciprocable between a seat 31 and stops 32.

The resiliently yieldable bladder or pumping chamber 13 has a first tubular body portion 33 defining the pumping chamber and a second, reduced diameter tubular portion 34 which receives and holds the dip tube 16.

An inlet check valve 35 is formed in the bladder 13 at the juncture between the two body portions 33 and 34, and includes a valve ball 36 reciprocable between a seat 37 and stops 38.

A diametrically enlarged retaining flange 39 is formed on the upper end of the bladder 13 and has a downwardly projecting sloping surface 40 cooperating with an oppositely sloping surface 41 on the upper end of the sleeve 12, which extends upwardly in the space between the bladder 13 and housing 21. The check valve 29 projects downwardly into the open upper end of the bladder 13 for controlling flow from the bladder.

A diametrically enlarged flange 42 is formed on the lower end of the sleeve 12 for cooperation with an end wall 43 on the closure or connecting ring 14. Suitable connecting means such as threads 43 are formed on the interior surface of skirt 45 of closure ring 14 for connecting the dispensing device to a container.

Figure 2:
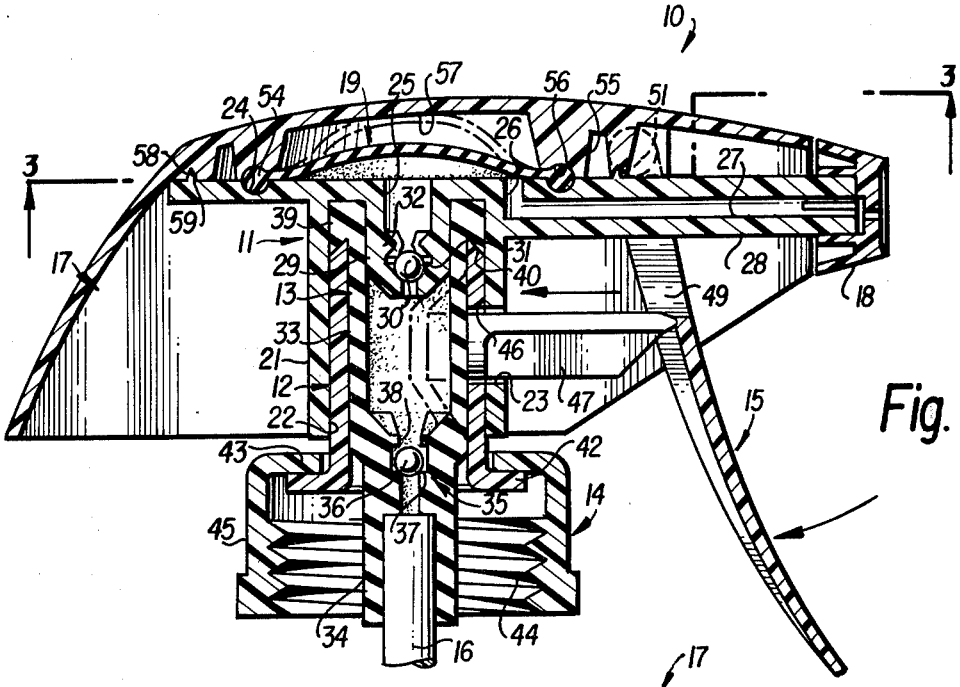
FIG. 2 is an enlarged, vertical sectional view of the dispenser of FIG. 1 and is taken along line 2—2, in FIG. 1.
Figure 3:
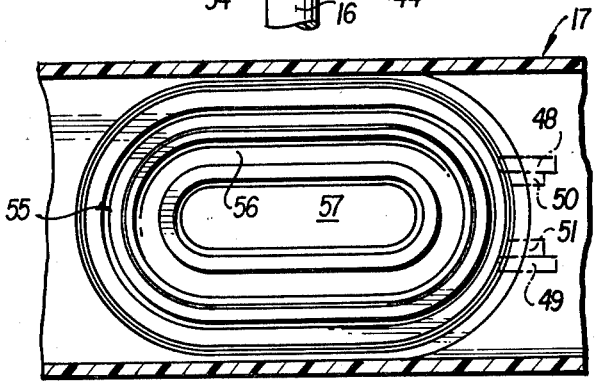
FIG. 3 is a horizontal view in section taken along line 3—3, in FIG. 2.
Figure 4:
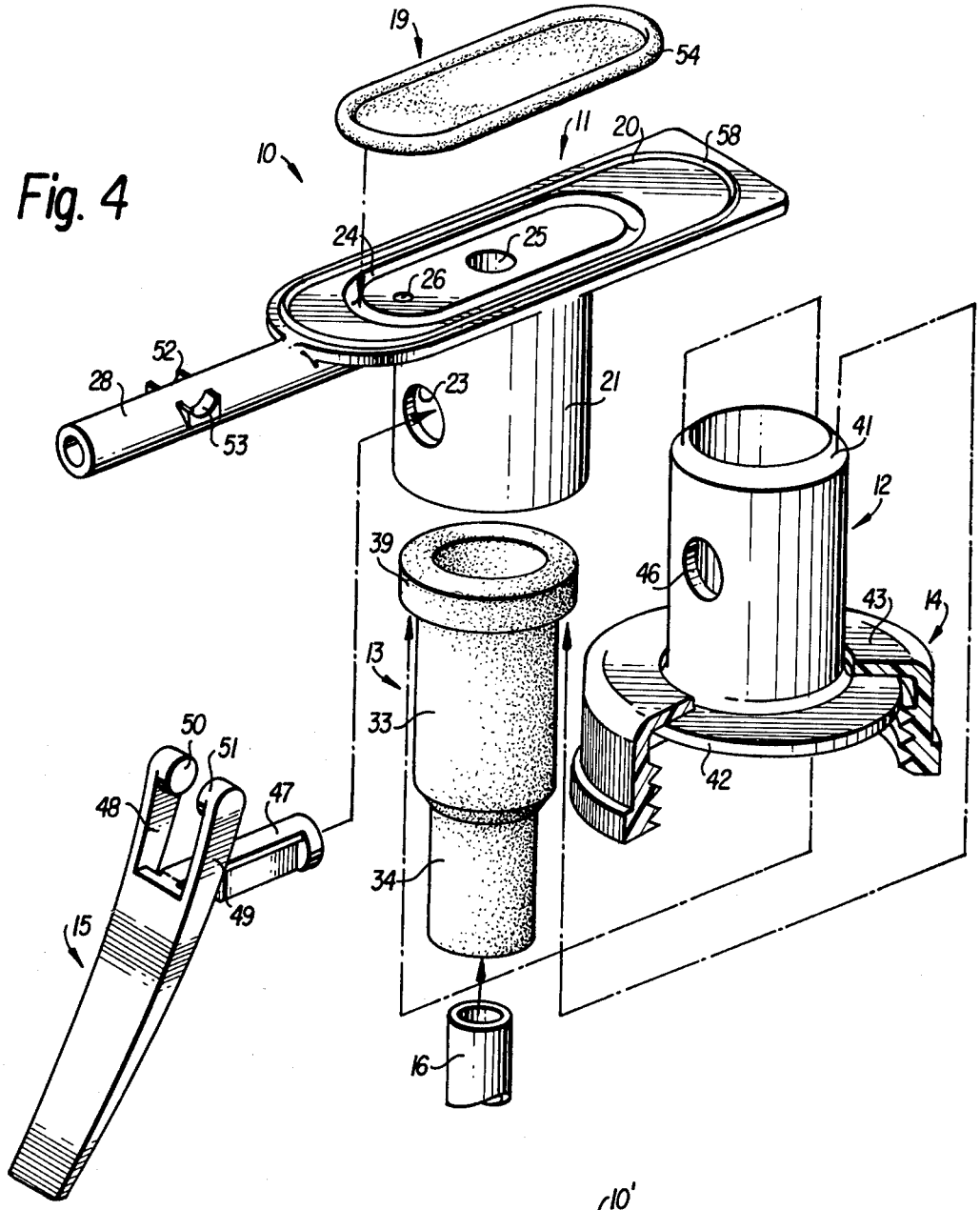
FIG. 4 is an enlarged, exploded perspective view of the dispenser of FIG. 1 with the shroud and nozzle removed.

The sleeve 12 has an opening 46 in the side thereof, which is aligned with the opening 23 through housing 21 when the parts are assembled as seen in FIG. 2, for receiving the plunger 47 of trigger actuator 15.

The trigger 15 has a pair of spaced apart, upwardly projecting pivot arms 48 and 49 thereon with inwardly directed pivot pins or stub shafts 50 and 51 at their upper ends which are pivotally received in stirrups or the like 52 and 53 formed on the nozzle tube 28.

The flexible, resiliently yieldable diaphragm 19 has an enlarged annular bead 54 on the periphery thereof and the bead 54 is received in the annular channel 24 in the top surface of valving plate 20 of manifold 11.

A downwardly projecting annular wall 55 on the underside of the top wall of the shroud 17 has an annular channel 56 formed therein which is in registry with the bead 54 when the parts are assembled as seen in FIG. 2, to securely clamp the diaphragm 19 in position with the flexible central portion thereof centrally disposed relative to the opening 25. The depending annular wall 55 defines an accumulating cavity 57 in the shroud into which the diaphragm 19 expands when pressurized fluid is admitted through the opening 25 to the space beneath the diaphragm.

An energy bead 58 is formed on the top surface of the valving closure 20 for cooperation with an energy concentrating channel 59 formed in the underside of the top wall of the shroud, whereby the application of ultrasonic energy effects an ultrasonic weld at this location to secure the shroud to the manifold.

The parts of the device may be secured together in any conventional manner, as by cementing, welding or the like, and may be manufactured from any suitable material. Because of the unique construction of the device, the parts may be made from any suitable material such as synthetic plastics or the like. The bladder 13 is preferably made of a rubber material and the natural resiliency thereof is such that it will return the trigger to its forward at-rest position, as seen in FIG. 2, when force is released from the trigger.

In use, the trigger 15 is forced rearwardly, extending the plunger 47 through the openings 23 and 46 and against the pumping chamber 33, collapsing the chamber and forcing air therefrom through the valve 29. Upon subsequent release of the trigger, the natural resiliency of the pumping chamber 33 acts against the plunger 47, moving the trigger forwardly to the position seen in FIG. 2 and thereby creating a low pressure within the pumping chamber, drawing material upwardly through dip tube 16, past check valve 35 into the pumping chamber. Subsequent movement of the trigger rearwardly to again collapse the pumping chamber pressurizes the material therein, forcing it outwardly through check valve 29 and through opening 25 into the area beneath diaphragm 19, thereby flexing the diaphragm 19 upwardly as seen in FIG. 2. The position of the outlet opening 26 and the elasticity of diaphragm 19 are such that a positive pressure is required in the accumulating chamber before the diaphragm will move away from the opening 26 to enable discharge of the product through the nozzle 18. Similarly, as the pressurized fluid is depleted from the accumulating chamber, the diaphragm will once again cover the opening 26 thereby terminating flow while the pressure is at a minimum value. The restriction to flow through the nozzle 18, the volume of the accumulating chamber and the elasticity of the diaphragm 19 are selected such that a continuous flow is obtained during pressurization and intake strokes of the trigger.

Of course, the nozzle 18 could be made adjustable into a plurality of positions having different restrictions to flow therethrough whereby the restriction to flow would be of such a value in relation to the elasticity of the diaphragm 19 and volume of the accumulating chamber that the material in the accumulating chamber would be quickly exhausted through the nozzle, thereby enabling an intermittent flow to be obtained.

MODIFICATION

Figure 5:
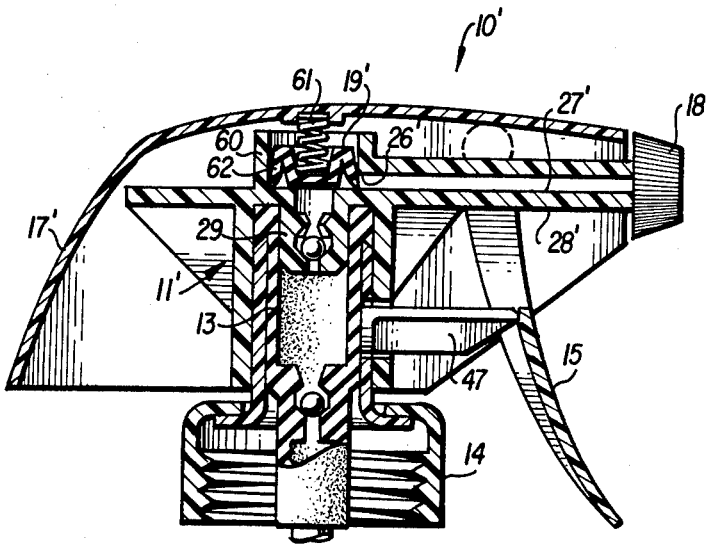
FIG. 5 is a view similar to FIG. 2 of a modification of the invention, wherein a different type of accumulating chamber is utilized.

In FIG. 5, a modification of the invention is indicated generally at 10' and is identical in all respects with the preferred form of the invention except that the accumulating chamber is defined by a piston 19' reciprocable in a cylinder 60 defined on the upper surface of the manifold 11'. The piston 19' is normally biased downwardly by a spring 61 engaged against the underside of the top wall of the shroud 17' and the piston 19'.

The discharge passage 27' through the nozzle tube 28' extends axially from an opening 26' in one side of the cylinder 60 at the bottom thereof.

The piston 19' has a depending skirt 62 thereon which is slidably sealed to the inner wall surface of the cylinder 60, and the skirt 62 acts as a valve in relation to the outlet opening 26' to prevent flow through the nozzle 18 when the pressure is below a predetermined minimum. In other words, as product is pressurized in the pumping chamber and forced through the valve 29 into the accumulating chamber beneath the piston 19', the skirt 62 will maintain the opening 26' closed until the positive pressure is reached. Similarly, as the pressure fluid is exhausted from the accumulating chamber, the skirt 62 will move downwardly into closing relationship to the opening 26' while a positive pressure still remains in the accumulating chamber.

An advantage of this form of the invention over the preferred form is that the rubber bladder 13 can be eliminated and a plastic piston 19' used in its place, thereby rendering the device compatible with additional materials.

As this invention may be embodied in several forms without departing from the spirit or essential characteristics thereof, the present embodiment is, therefore, illustrative and not restrictive, since the scope of the invention is defined by the appended claims rather than by the description preceeding them, and all changes that fall within the metes and bounds of the claims or that form their functional as well as conjointly cooperative equivalents are, therefore, intended to be embraced by those claims.

We claim:

1. A trigger operated dispenser, comprising: a body having means thereon for connection to a container of material to be dispensed; a resiliently yieldable pumping chamber carried by the body for receiving material from the container and pressurizing it; a trigger actuator pivotally carried by the body and having a plunger extending into the body into engagement with the pumping chamber to actuate the pumping chamber to pressurize material therein; and an expansible accumulating chamber carried by the body in communication with the pumping chamber to receive pressurized material from the pumping chamber as the material is being pressurized by the pumping chamber for discharge from the dispenser, said accumulating chamber enabling a continuous discharge of material from the dispenser by providing a reservoir of material for discharge while the trigger actuator is being moved to enlarge the pumping chamber on an intake stroke of the trigger; a discharge nozzle on the body for receiving material from the accumulating chamber; and said accumulating chamber having an inlet from the pumping chamber and an outlet to the nozzle, and including a flexible, resiliently yieldable diaphragm extending across the pumping chamber, a peripheral portion of the diaphragm extending across the outlet from the accumulating chamber and comprising an outlet valve means, said peripheral portion disposed against said outlet in closing relationship thereto when the pressure of material in said accumulating chamber is below a predetermined minimum, and an outer peripheral part of the diaphragm being secured to the body.

2. A dispenser as in claim 1, wherein: the dispenser comprises an assembly including the body, trigger, pumping chamber, and accumulating chamber; and the means for connection to a container comprises a threaded closure ring carried by the body for releasable attachment of the dispenser assembly to a container.

3. A dispenser as in claim 1, wherein: the pumping chamber comprises a resilient tubular bladder having an inlet end for connection with the material in a container, and an outlet end in communication with the accumulating chamber; and check valve means in the bladder on opposite ends of the pumping chamber to control flow therethrough.

4. A dispenser as in claim 1, wherein: the peripheral margin of said diaphragm has an enlarged bead thereon received in a channel formed in the body of said dispenser, said bead being held in said channel by engagement with a depending annular wall on a shroud secured in enclosing relationship to said dispenser assembly.

* * * * *